US012807379B2

(12) United States Patent
Chen

(10) Patent No.: US 12,807,379 B2
(45) Date of Patent: Nov. 24, 2026

(54) 360-DEGREE OMNIDIRECTIONAL DRINKING CUP

(71) Applicant: Ningbo Raffini Import & Export Co., Ltd, Zhejiang (CN)

(72) Inventor: Qiwei Chen, Zhejiang (CN)

(73) Assignee: Ningbo Raffini Import & Export Co., Ltd, Zhejiang (CN)

( * ) Notice: Subject to any disclaimer, the term of this patent is extended or adjusted under 35 U.S.C. 154(b) by 0 days.

(21) Appl. No.: 19/079,656

(22) Filed: Mar. 14, 2025

(65) Prior Publication Data

US 2026/0145850 A1 May 28, 2026

(30) Foreign Application Priority Data

Nov. 28, 2024 (CN) ..... 202422921027.6

(51) Int. Cl.
*B65D 47/24* (2006.01)
*A47G 19/22* (2006.01)
*B65D 47/32* (2006.01)

(52) U.S. Cl.
CPC ..... *B65D 47/247* (2013.01); *A47G 19/2272* (2013.01); *B65D 47/32* (2013.01)

(58) Field of Classification Search
CPC ..... B65D 47/247; B65D 47/32; A47G 19/2272
See application file for complete search history.

(56) References Cited

U.S. PATENT DOCUMENTS

| | | | | |
|---|---|---|---|---|
| 7,549,556 | B2 * | 6/2009 | Miller | A47G 19/2272 220/717 |
| 7,575,126 | B2 * | 8/2009 | Kemper | F16K 15/144 220/717 |
| 9,241,588 | B2 * | 1/2016 | Dunn | A47G 19/2272 |
| 10,492,634 | B2 * | 12/2019 | Beltrami | B65D 53/02 |
| 2011/0084084 | A1 * | 4/2011 | Berg | A47G 19/2272 220/703 |

* cited by examiner

*Primary Examiner* — James N Smalley
(74) *Attorney, Agent, or Firm* — Hawaii Patent Services; Nathaniel K. Fedde; Kenton N. Fedde

(57) ABSTRACT

The present disclosure provides a 360-degree omnidirectional drinking cup, comprising a cup body, a cup lid, and a detachable sealing valve. The cup lid is provided with a first accommodating cavity communicating with the cup body, in which the sealing valve can be accommodated to form a channel for water flow. The lower end of the sealing valve is provided with a sealing column, which is elastically connected to a limiting part inside the cup lid, and the outer peripheral wall of the sealing column is in sealed connection with the inner wall of the limiting part. This design prevents the sealing valve from directly contacting water, thus avoiding leakage and preventing water from splashing out when the sealing valve is removed for cleaning.

17 Claims, 6 Drawing Sheets

360-DEGREE OMNIDIRECTIONAL DRINKING CUP

CROSS-REFERENCE TO RELATED APPLICATIONS

This application claims the priority of the Chinese utility model patent with Application No. 202422921027.6, filed on Nov. 28, 2024, titled "360-degree Omnidirectional Drinking Cup", the content of which is incorporated herein by reference in its entirety.

TECHNICAL FIELD

The present disclosure relates to the technical field of water cups, particularly, to a 360-degree omnidirectional drinking cup.

BACKGROUND

During the growth and learning process of infants and young children, due to lack of experience and balance ability, they tend to shake or tip over the cup when learning to drink water, causing the water in the cup to spill. Moreover, the water output of ordinary cups is relatively large, which can easily cause children to choke. Therefore, training cups that are easy for children to use have appeared on the market. In ordinary training cups, the sealing valve is in direct contact with the water inside the cup.

The existing Chinese utility model patent No. 201821458774.9 discloses an anti-spill drinking cup, and an U.S. Pat. No. 11,937,716 discloses a straw cup with a nozzleless training lid assembly. In the above-mentioned existing patent technologies, when the sealing valve is pulled out for cleaning, the water inside the cup is prone to splash out under the combined action of pulling force and air pressure, making cleaning inconvenient and requiring more effort to pull out.

SUMMARY

To solve the problems raised in the background technology, the present disclosure adopts the following technical solutions:

The present disclosure provides a 360-degree omnidirectional drinking cup, including a cup body, a cup lid, and an elastic sealing valve, wherein the cup lid is covered on the cup body, an upper end of the cup lid is recessed to form a first accommodating cavity communicating with the cup body, and the sealing valve is detachably accommodated in the first accommodating cavity and forms a channel for water flow with the cup lid; and a lower end of the sealing valve is provided with a sealing column, and the first accommodating cavity comprises a limiting part, wherein the sealing column is elastically connected to the limiting part, and an outer peripheral wall of the sealing column is in sealed connection with an inner peripheral wall of the limiting part.

The present disclosure further provides a 360-degree omnidirectional drinking cup, which includes a cup body, and a cup lid detachably connected to the cup body, wherein the cup lid forms a first accommodating cavity communicating with the cup body; an elastic sealing valve detachably disposed in the first accommodating cavity, wherein the sealing valve includes a sealing column extending downward from its lower end; the first accommodating cavity includes a limiting part configured to engage with the sealing column; the bottom of the sealing column is recessed to form a weight-reducing groove, which communicates with the limiting part; the bottom wall of the limiting part is provided with a first vent, which is configured to regulate the air pressure between the sealing column and the limiting part.

BRIEF DESCRIPTION OF DRAWINGS

The drawings, which form a part of this application, are intended to provide a further understanding of the present disclosure. The illustrative embodiments of the disclosure and the descriptions thereof are used to explain the disclosure and do not constitute an improper limitation on the disclosure. In the drawings.

Figure 1:
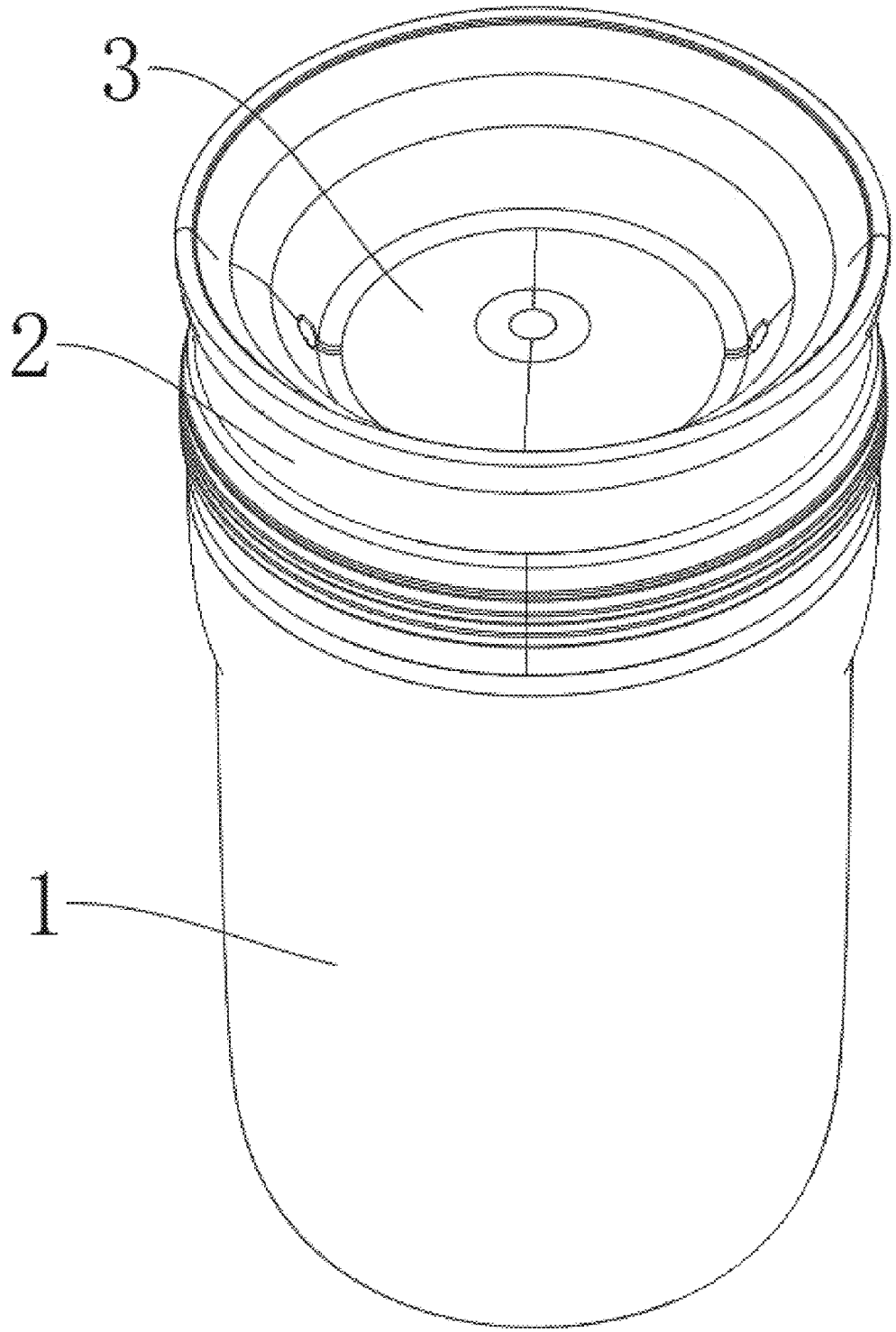
FIG. 1 is a structural diagram of the 360-degree omnidirectional drinking cup according to an embodiment of the present disclosure.

In the drawings, the above drawings include the following reference signs:

Cup body (1); Cup lid (2); First accommodating cavity (21); Limiting part (211); Second rib (212); First vent (213); Water outlet hole (22); Sealing valve (3); Sealing column (31); First rib (311); Weight-reducing groove (312); Third rib (32); Upper lip part (33); Second vent (331); Second accommodating cavity (34).

DESCRIPTION OF EMBODIMENTS

The technical solution in the embodiment of the present disclosure will be clearly and completely described below with reference to the drawings. Obviously, the described embodiment is part of, rather than all of the embodiments of the present disclosure. The following description of at least one exemplary embodiment is illustrative in nature and is in no way intended to limit the present disclosure, its application or uses. Based on the embodiments in the present disclosure, all other embodiments obtained by those skilled in the art without creative work belong to the scope of protection of the present disclosure.

It should be noted that the terminology used here is only for describing specific embodiments, and is not intended to limit exemplary embodiments according to the present application. As used herein, the singular form is also intended to include the plural form unless the context clearly indicates otherwise. Furthermore, it should be appreciated that when the terms "comprising" and/or "including" are used in this specification, they specify the presence of features, steps, operations, devices, components and/or combinations thereof.

Unless otherwise specified, the relative arrangement of components and steps, numerical expressions and numerical values set forth in these embodiments do not limit the scope of the present disclosure. At the same time, it should be appreciated that for the convenience of description, the dimensions of various parts shown in the drawings are not drawn according to the actual scale relationship. Techniques, methods and equipment known to those skilled in the art may not be discussed in detail, but in appropriate cases, they should be regarded as part of the authorization specification. In all the examples shown and discussed herein, any specific values should be interpreted as illustrative, and not as limiting. Therefore, other examples of exemplary embodiments may have different values. It should be noted that similar numbers and letters indicate similar items in the following drawings, therefore once an item is defined in one drawing, it does not need to be further discussed in subsequent drawings.

An embodiment of the present disclosure provides a 360-degree omnidirectional drinking cup. As shown in FIGS. 1-6, it includes a cup body 1, a cup lid 2, and an elastic sealing valve 3. The cup lid 2 is covered on the cup body 1. The upper end of the cup lid 2 is recessed to form a first accommodating cavity 21 communicating with the cup body 1. The sealing valve 3 is detachably accommodated in the first accommodating cavity 21 and forms a water flow channel with the cup lid 2. The lower end of the sealing valve 3 is provided with a sealing column 31. The first accommodating cavity 21 includes a limiting part 211. The sealing column 31 is elastically connected to the limiting part 211, and the outer peripheral wall of the sealing column 31 is in sealed connection with the inner peripheral wall of the limiting part 211.

Figure 4:
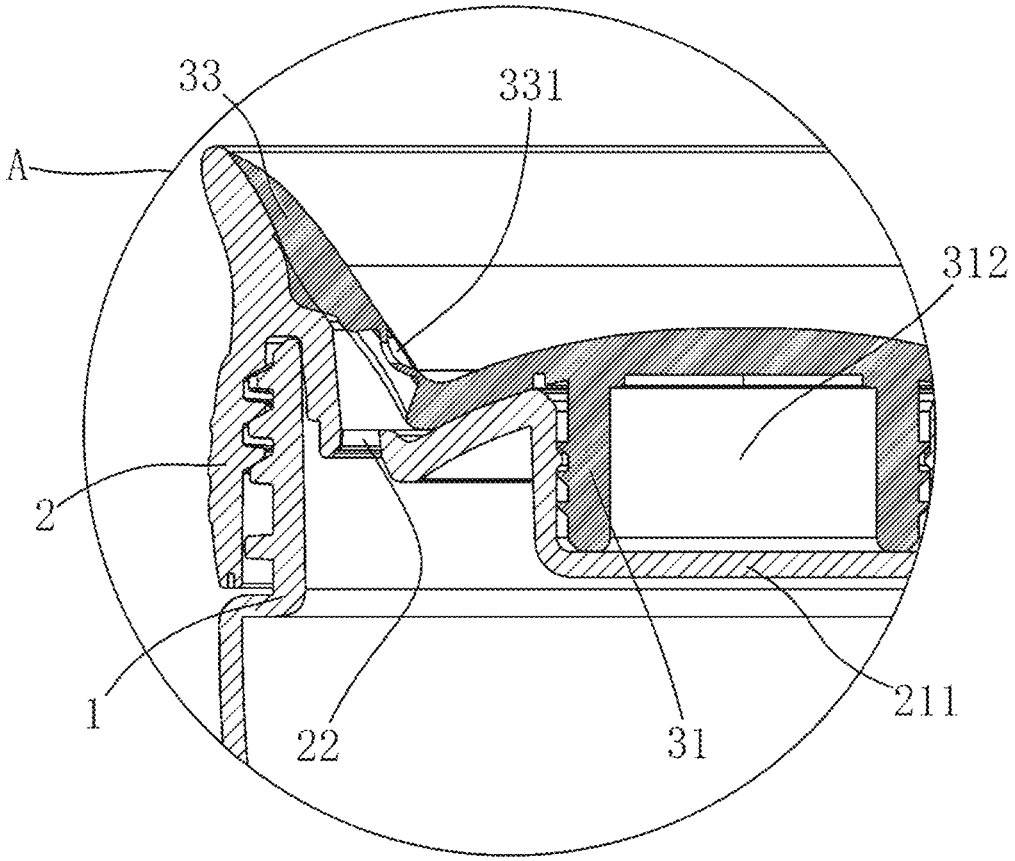
FIG. 4 is an enlarged view of part A in FIG. 3.

As shown in FIGS. 1 and 4, in this embodiment, the sealing valve 3 is made of silicone, and the sealing column 31 is integrally formed with the sealing valve 3 using a soft rubber process. The cup body 1 and the cup lid 2 are connected via threads. The sealing valve 3 is elastically engaged with the limiting part 211, ensuring both sealing and the stability of the connection structure between the sealing valve 3 and the cup lid 2, with a simple and ingenious design.

Compared to existing technology, the 360-degree omnidirectional drinking cup in this disclosure features a sealing column 31 on the sealing valve 3 and a limiting part 211 on the cup lid 2 to accommodate the sealing column 31. The outer peripheral wall of the sealing column 31 is in sealed connection with the inner peripheral wall of the limiting part 211, ensuring that the sealing valve 3 and the cup lid 2 are in sealed connection via the sealing column 31 and the limiting part 211. The sealing valve 3 does not directly contact the water in the cup body 1, preventing leakage and avoiding water splashing when the sealing valve 3 is removed for cleaning.

The outer peripheral wall of the sealing column 31 is circumferentially provided with an elastic first rib 311, and the inner peripheral wall of the limiting part 211 is circumferentially provided with a second rib 212. The first rib 311 and the second rib 212 elastically abut against each other to seal the connection between the sealing column 31 and the limiting part 211. In other embodiments (not shown), a threaded connection can be used to achieve the seal between the sealing column 31 and the limiting part 211. Specifically, threads are provided on the outer peripheral wall of the sealing column 31 and the inner peripheral wall of the limiting part 211. When the sealing column 31 is screwed into the limiting part 211, the two are tightly engaged via the threads, achieving a sealed connection. This threaded sealing method leverages the tight fit of the threads, further enhancing the reliability of the seal.

Figure 5:
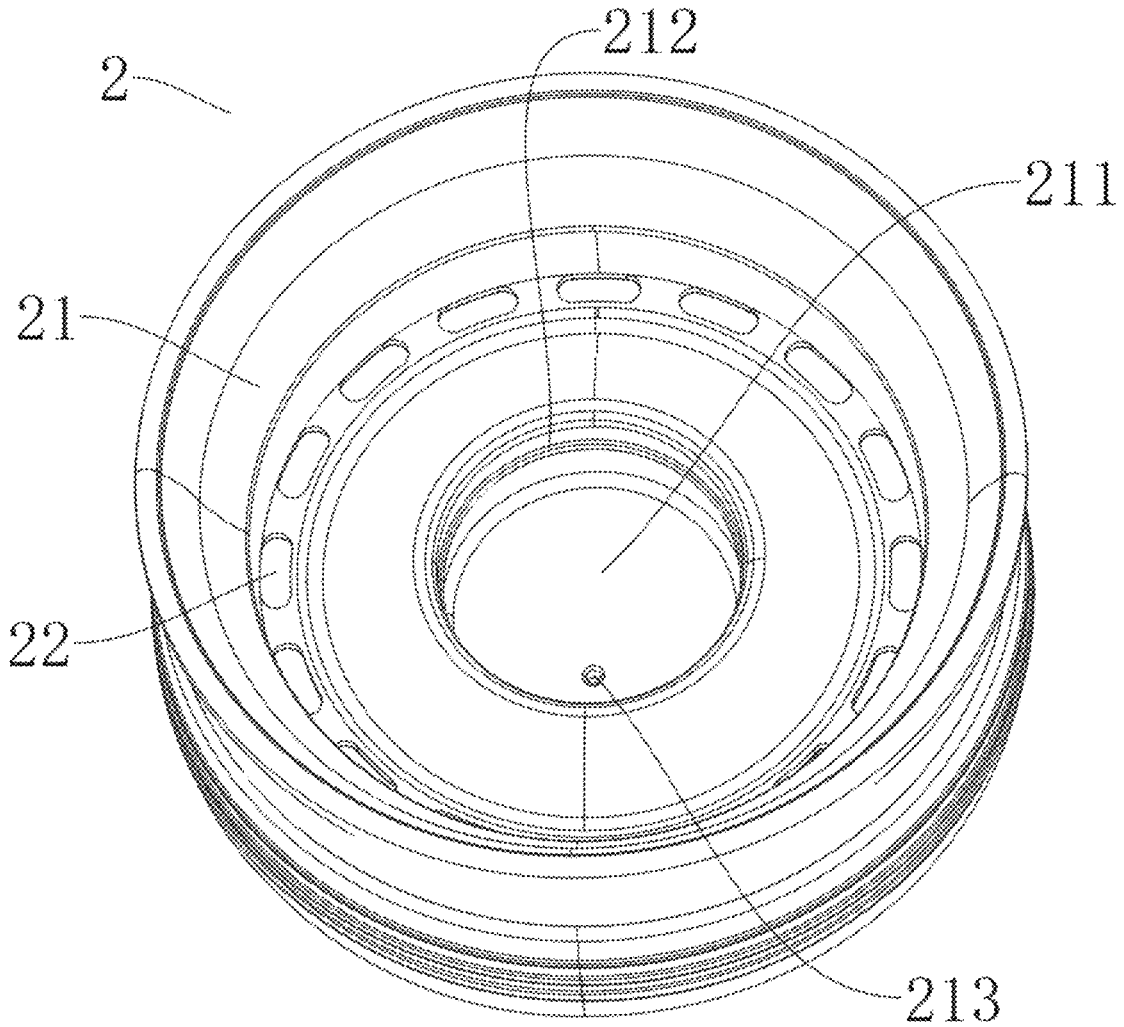
FIG. 5 is a structural diagram of the cup lid according to an embodiment of the present disclosure.
Figure 6:
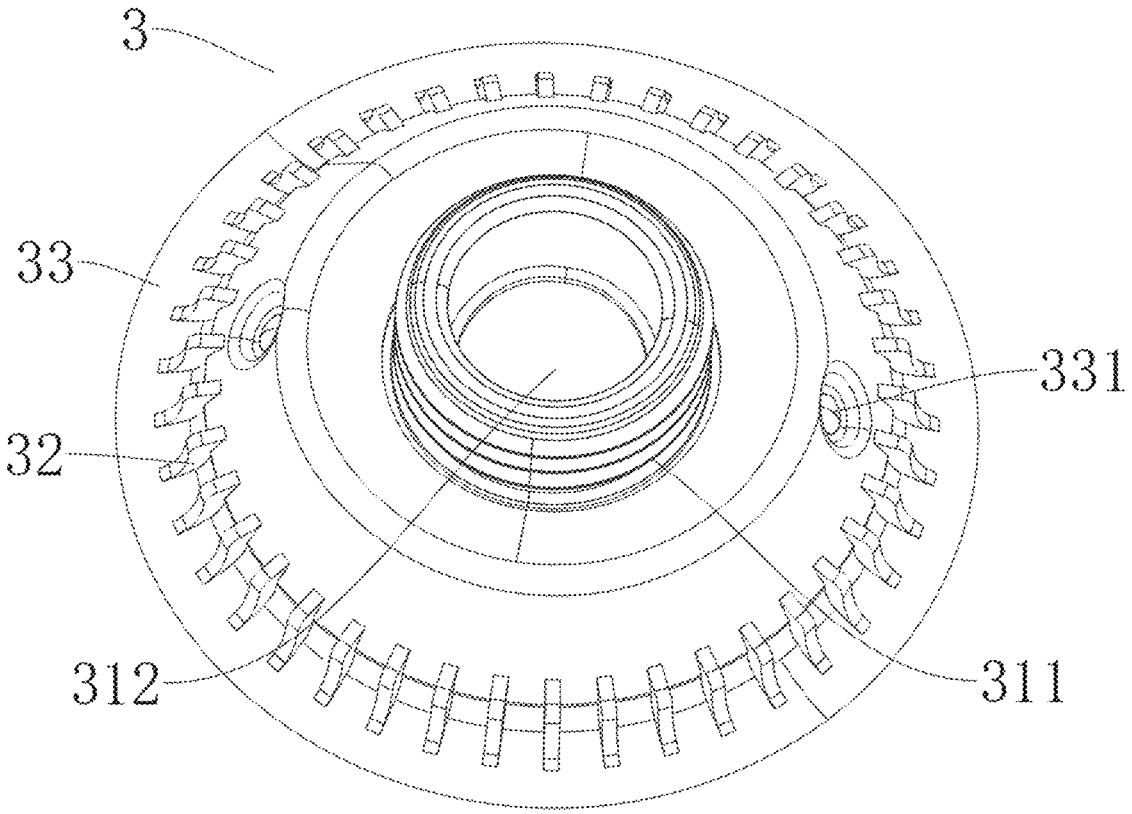
FIG. 6 is a structural diagram of the sealing valve according to an embodiment of the present disclosure.

As shown in FIGS. 4-6, in this embodiment, a plurality of first ribs 311 are provided on the outer peripheral wall of the sealing column 31 at intervals. The elastic engagement of the first ribs 311 and the second ribs 212 ensures a tight connection between the sealing valve 3 and the cup lid 2, while also making it easy to disassemble, install, and clean.

The bottom wall of the limiting part 211 is provided with a first vent 213, which is used to adjust the air pressure between the sealing column 31 and the limiting part 211.

As shown in FIG. 5, in this embodiment, there is one first vent 213. When installing the sealing column 31, it is necessary to press the sealing column 31 downward into the limiting part 211. The first vent 213 can squeeze the gas in the limiting part 211 into the cup body 1 under the pressure of the sealing column 31, thereby making the connection between the sealing column 31 and the limiting part 211 tighter. When the sealing valve 3 is pulled out under external force, the first vent 213 can balance the air pressure between the sealing column 31 and the limiting part 211, allowing the sealing valve 3 to be smoothly removed from the limiting part 211.

The cup lid 2 is provided with several water outlet holes 22 communicating with the cup body 1. Several strip-shaped third ribs 32 are provided at the bottom of the sealing valve 3 at intervals. The strip-shaped third ribs 32 are located above the water outlet holes 22. When the sealing column 31 forms an elastic seal with the limiting part 211, the third ribs 32 adhere to the inner wall of the first accommodating cavity 21 to form a plurality of diversion channels for water flow.

As shown in FIG. 5, in this embodiment, under the action of the diversion channels, when a child drinks water, the water flow can be divided into a plurality of small streams to prevent a large amount of water from entering the child's mouth at the same time, which could cause choking. At the same time, the third ribs 32 are designed to fit the child's oral cavity. When drinking, the third ribs 32 also support the sealing valve 3, forming a closed space between the valve and the child's mouth.

In other embodiments (not shown), the third ribs 32 can be distributed at uneven intervals. Specifically, the intervals of the third rib 32 on one side of the sealing valve 3 can be set smaller, causing the water flow to be more concentrated on this side, while the intervals on the other side can be set larger, allowing the water flow to be more dispersed. In this way, the size and distribution of the water flow can be adjusted according to different positions to meet the needs of different users, especially children of different ages.

A number of water outlet holes 22 are evenly distributed circumferentially, allowing the cup to discharge water in all 360-degree directions.

As shown in FIG. 5, in this embodiment, the water outlet holes 22 are waist-shaped and there are 16 of them. The upper lip part 33 is ring-shaped, allowing the user to suck water from any position on the upper lip part 33.

The upper end of the sealing valve 3 is recessed to form a bowl-shaped second accommodating cavity 34, which can accommodate the water flowing between the cup lid 2 and the sealing valve 3.

Figure 2:
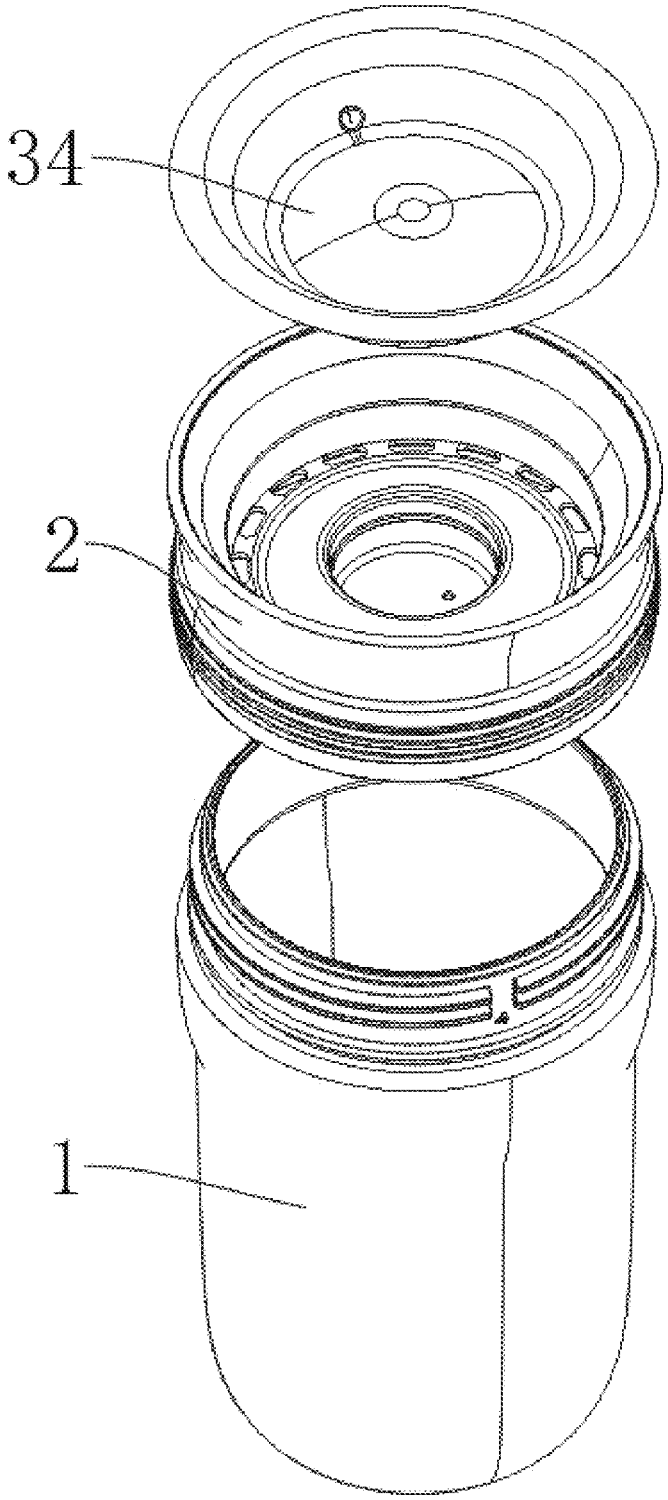
FIG. 2 is an exploded view of the 360-degree omnidirectional drinking cup according to an embodiment of the present disclosure.
Figure 3:
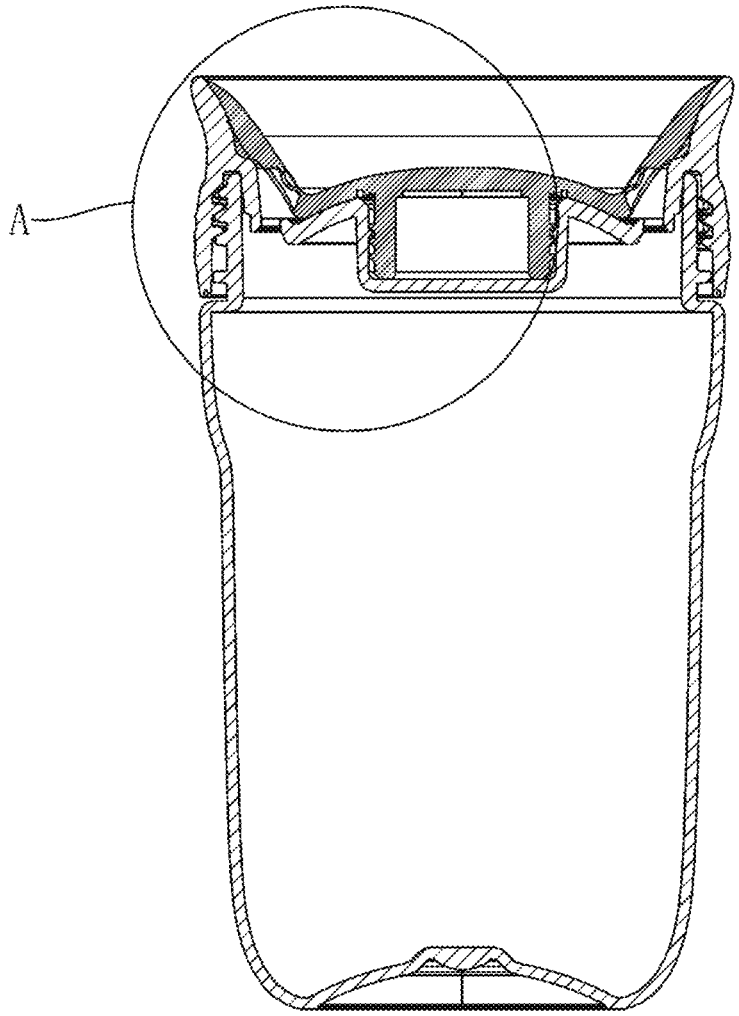
FIG. 3 is a cross-sectional view of a 360-degree omnidirectional drinking cup according to an embodiment of the present disclosure.

As shown in FIG. 2, in this embodiment, the second accommodating cavity 34 can hold a small amount of water, further reducing water spillage during the child's drinking process.

The bottom of the sealing column 31 is recessed to form a weight-reducing groove 312 for reducing weight, and the weight-reducing groove 312 communicates with the limiting part 211.

As shown in FIGS. 4 and 6, in this embodiment, the weight-reducing groove 312 not only reduces the weight of the sealing column 31, saving material, but also reduces the wall thickness of the sealing column 31, making it easier for the sealing column 31 to undergo elastic deformation. This makes the installation and removal of the sealing column 31 and the limiting part 211 more convenient and labor-saving.

The upper edge of the sealing valve 3 is provided with an elastic upper lip part 33. When the upper lip part 33 fits against the inner wall of the cup lid 2, a sealed state is formed between the upper lip part 33 and the cup lid 2. When an opening is formed between the upper lip part 33 and the inner wall of the cup lid 2 under external force, the opening communicates with the cup body 1 to allow water to flow out.

As shown in FIGS. 4 and 6, in this embodiment, the surfaces of the inner walls of the upper lip part 33 and the inner wall of the cup lid 2 are smooth. When not in use, the upper lip part 33 tightly fits against the inner wall of the cup lid 2 under its own elasticity and air pressure, forming a sealed state. At this time, even if the cup body 1 is shaken, water will not spill out. The top of the upper lip part 33 is close in height to the top of the cup lid 2. When a child sucks or bites the upper lip part 33, the suction or biting force can cause the upper lip part 33 to undergo elastic deformation, forming an opening with the cup lid 2, allowing water from the cup body 1 to flow into the child's mouth through the opening.

The upper lip part 33 is provided with a second vent 331 that can be elastically opened and closed. The second vent 331 communicates with the first accommodating cavity 21 and is used to balance the air pressure between the upper lip part 33 and the cup lid 2.

As shown in FIGS. 4 and 6, in this embodiment, there are two second vents 331, located between the water outlet holes 22 and the third ribs 32. The second vent 331 is a linear slit. When not drinking, the linear slit does not create a gap, and water does not overflow from the linear slit. When drinking, the internal pressure of the cup body 1 decreases, causing the external atmospheric pressure to be greater than the internal pressure of the cup body 1. The linear slit deforms under pressure to create a gap, allowing external air to enter the cup body 1 through the gap, balancing the internal pressure of the cup body 1 with the external atmospheric pressure, thus enabling the user to drink smoothly.

The hardness of the sealing column 31 is greater than that of the upper lip part 33.

As shown in FIG. 4, in this embodiment, when a child sucks on the upper lip part 33, the lower hardness of the upper lip part 33 allows it to deform more easily, facilitating water absorption. The higher hardness of the sealing column 31 strengthens the connection between the sealing valve 3 and the cup lid 2, resulting in a better sealing effect and making it less likely for the sealing valve 3 to detach. Preferably, the Shore hardness of the sealing column (31) is 70 A-80 A, and the Shore hardness of the upper lip part (33) is 40 A-60 A.

In the description of the present disclosure, it should be appreciated that directional terms such as "front, rear, up, down, left, right", "horizontal, vertical, perpendicular, horizontal" and "top, bottom" etc. indicate the orientation or positional relationship based on the orientation or positional relationship shown in the drawings, and are only for the convenience of describing the present disclosure and simplifying the description. In the absence of a contrary explanation, these directional terms do not indicate or imply that the device or element referred to must have a specific orientation or be constructed and operated in a specific orientation, and therefore should not be understood as limiting the scope of protection of the present disclosure; the directional terms "inside, outside" refer to the inside and outside relative to the contour of each component itself.

For the convenience of description, spatial relative terms such as "on . . . ", "above . . . ", "on the upper surface of . . . ", "upper" etc. may be used here to describe the spatial positional relationship of a device or feature with other devices or features as shown in the drawings. It should be appreciated that spatial relative terms are intended to encompass different orientations of the device in use or operation other than the orientation described in the drawings. For example, if the device in the drawing is inverted, the device described as "above other devices or structures" or "on other devices or structures" will subsequently be positioned as "below other devices or structures" or "under other devices or structures". Thus, the exemplary term "above" can include both "above" and "below" orientations. The device can also be positioned in other different ways (rotated 90 degrees or in other orientations), and the spatial relative descriptions used here should be interpreted accordingly.

In addition, it should be noted that the use of terms such as "first", "second" etc. to define components is for the convenience of distinguishing the corresponding components. Unless otherwise stated, the above terms have no special meaning, and therefore should not be understood as limiting the scope of protection of the present disclosure.

The above description is only a preferred embodiment of the present disclosure and is not intended to limit the present disclosure. For those skilled in the art, the present disclosure can have various modifications and changes. Any modifications, equivalent replacements, improvements etc. made within the spirit and principles of the present disclosure should be included within the scope of protection of the present disclosure.

What is claimed is:

1. A 360-degree omnidirectional drinking cup, comprising a cup body, a cup lid, and an elastic sealing valve, wherein the cup lid is covered on the cup body, an upper end of the cup lid is recessed to form a first accommodating cavity communicating with the cup body, and the sealing valve is detachably accommodated in the first accommodating cavity, wherein the sealing valve the cup lid together define a channel for water flow; and a lower end of the sealing valve is provided with a sealing column, and the first accommodating cavity comprises a limiting part, wherein the sealing column is elastically connected to the limiting part, and an outer peripheral wall of the sealing column is in sealed connection with an inner peripheral wall of the limiting part, wherein a bottom of the sealing column is recessed to form a weight-reducing groove, which is connected to the limiting part; and a bottom wall of the limiting part is provided with a first vent, which is configured to regulate air pressure between the sealing column and the limiting part.

2. The 360-degree omnidirectional drinking cup according to claim 1, wherein an upper edge of the sealing valve is provided with an upper lip part, wherein when the limiting part is engaged with the sealing column, the upper lip part adheres to an inner wall of the first accommodating cavity to form an elastic seal.

3. The 360-degree omnidirectional drinking cup according to claim 2, wherein the upper lip part is provided with a second vent, which communicates with the first accommodating cavity to balance an air pressure between the upper lip part and the cup lid.

4. The 360-degree omnidirectional drinking cup according to claim 3, wherein the second vent is a linear slit, wherein when not in use, the second vent is in a sealed state, and a fluid inside the cup body cannot pass through the second vent; when in use, an internal pressure of the cup body decreases and an external atmospheric pressure is greater than the internal pressure of the cup body, causing the second vent to deform under pressure, at which point the second vent is in an open state.

5. The 360-degree omnidirectional drinking cup according to claim 2, wherein a hardness of the sealing column is greater than that of the upper lip part.

6. The 360-degree omnidirectional drinking cup according to claim 1, wherein the sealing valve is made of silicone, and the sealing column is integrally formed with the sealing valve.

7. The 360-degree omnidirectional drinking cup according to claim 1, wherein the cup body and the cup lid are connected by threads.

8. A 360-degree omnidirectional drinking cup, comprising a cup body, a cup lid, and an elastic sealing valve, wherein the cup lid is covered on the cup body, an upper end of the cup lid is recessed to form a first accommodating cavity communicating with the cup body, and the sealing valve is detachably accommodated in the first accommodating cavity, wherein the sealing valve and the cup lid together define a channel for water flow; and a lower end of the sealing valve comprises a sealing column, and the first accommodating cavity comprises a limiting part, wherein the sealing column is elastically connected to the limiting part, and an outer peripheral wall of the sealing column is in sealed connection with an inner peripheral wall of the limiting part;

wherein the outer peripheral wall of the sealing column is circumferentially provided with an elastic first rib, and the inner peripheral wall of the limiting part is circumferentially provided with a second rib, wherein the first rib elastically abuts against the second rib to seal the sealing column with the limiting part.

9. The 360-degree omnidirectional drinking cup according to claim 8, wherein a first vent is provided on a bottom wall of the limiting part, and the first vent is configured to adjust an air pressure between the sealing column and the limiting part.

10. The 360-degree omnidirectional drinking cup according to claim 8, wherein the cup lid is provided with several water outlet holes communicating with the cup body, and several strip-shaped third ribs are distributed at a bottom of the sealing valve at intervals, wherein the third ribs are located above the several water outlet holes to form a plurality of diversion channels for water flow.

11. The 360-degree omnidirectional drinking cup according to claim 10, wherein the several water outlet holes are uniformly distributed circumferentially to enable the drinking cup to discharge water omnidirectionally.

12. The 360-degree omnidirectional drinking cup according to claim 8, wherein an upper end of the sealing valve is recessed to form a bowl-shaped second accommodating cavity, which can accommodate water flowing out between the cup lid and the sealing valve.

13. The 360-degree omnidirectional drinking cup according to claim 8, wherein a bottom of the sealing column is recessed to form a weight-reducing groove to reduce weight, and the weight-reducing groove communicates with the limiting part.

14. The 360-degree omnidirectional drinking cup according to claim 8, wherein an upper edge of the sealing valve is provided with an elastic upper lip part, wherein when the upper lip part fits with an inner wall of the cup lid, the upper lip part and the cup lid are in a sealed state, and when an opening is formed between the upper lip part and the inner wall of the cup lid under an external force, the opening communicates with the cup body to discharge water.

15. The 360-degree omnidirectional drinking cup according to claim 14, wherein the upper lip part is provided with a second vent that can be elastically opened and closed, the second vent communicates with the first accommodating cavity, and the second vent is configured to balance an air pressure between the upper lip part and the cup lid.

16. The 360-degree omnidirectional drinking cup according to claim 14, wherein a hardness of the sealing column is greater than that of the upper lip part.

17. The 360-degree omnidirectional drinking cup according to claim 1, wherein the outer peripheral wall is cylindrical with an outside diameter and the inner peripheral wall is cylindrical and defines a recess with an inside diameter.

* * * * *